United States Patent [19]

Stahl

[11] 4,007,839

[45] Feb. 15, 1977

[54] THREE-LEVEL FULL SLIDE-ON CONTAINER

[75] Inventor: Edward L. Stahl, Richmond, Mich.

[73] Assignee: Pinckney Molded Plastics, Inc., Pinckney, Mich.

[22] Filed: Sept. 29, 1975

[21] Appl. No.: 617,592

[52] U.S. Cl. ..... 206/503; 206/505; 220/23.83

[51] Int. Cl.[2] ..... B65D 21/02; B65D 21/00

[58] Field of Search ..... 206/505, 503, 72, 501, 206/507, 516, 518, 519; 220/23.83, 22, 22.1, 22.2, 22.3; 211/126, 128

[56] References Cited

UNITED STATES PATENTS

| | | | |
|---|---|---|---|
| 3,238,004 | 3/1966 | Goebel | 220/22 X |
| 3,398,840 | 8/1968 | Wilson | 206/505 X |
| 3,404,804 | 10/1968 | Frater et al. | 206/505 |

*Primary Examiner*—William Price
*Assistant Examiner*—Steven M. Pollard
*Attorney, Agent, or Firm*—Whittemore, Hulbert & Belknap

[57] ABSTRACT

A container designed to stack with another container of identical construction at a plurality of different levels. The container is a full slide-on container, that is it can be stacked by sliding it horizontally over the full width of another container. A drawer or tray in the bottom of the container may be withdrawn by a horizontal sliding movement through the open front of the container.

18 Claims, 29 Drawing Figures

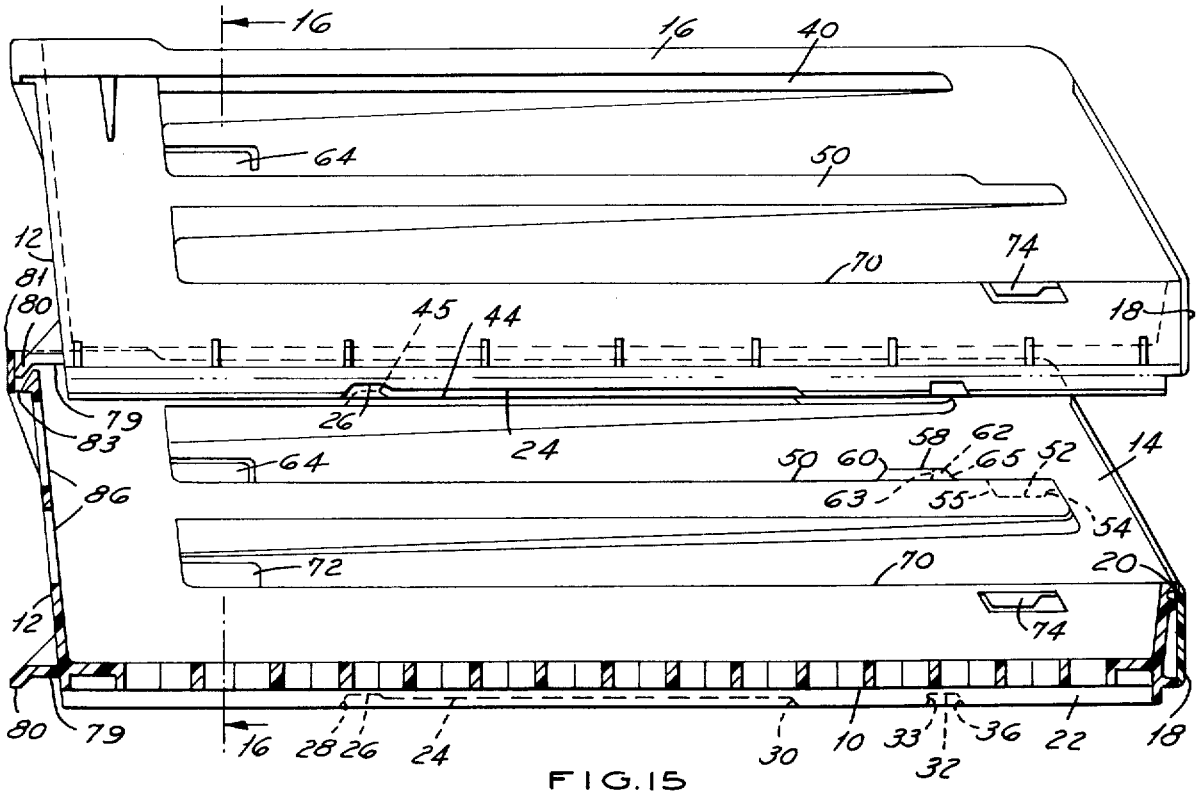
FIG.15
FIG.12
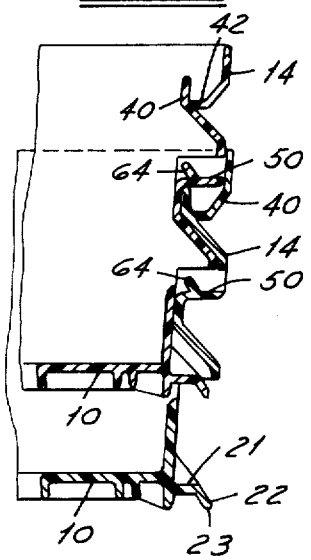
FIG.14
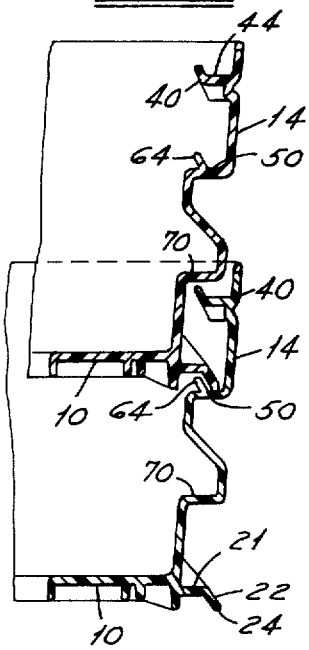
FIG.16
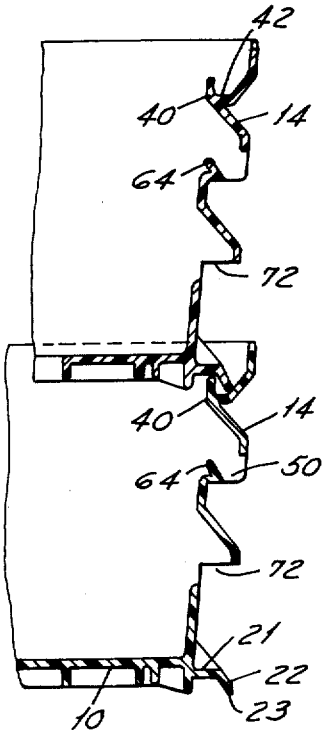

THREE-LEVEL FULL SLIDE-ON CONTAINER

SUMMARY OF THE INVENTION

The container of this invention has a substantially open front and is capable of stacking at a plurality of different levels with a second container of identical construction by a horizontal sliding movement through the open front of the container.

In order to fully utilize the space between the lower container and an upper container stacked at the lowermost level, a drawer is provided in the bottom of the lower container. Goods contained in the bottom of the lower container can thus easily be removed by pulling out the drawer.

The invention also contemplates the provision of means for resisting movement of the upper container away from its stacked position on a lower container, as well as means for resisting spreading of the lower container when supporting a heavy load.

In the drawings:

FIG. 12 is a sectional view taken on the line 12—12 in FIG. 10.

FIG. 14 is a sectional view taken on the line 14—14 in FIG. 13.

FIG. 15 is a side view similar to FIGS. 10 and 13 showing the two containers stacked at the uppermost level.

FIG. 16 is a sectional view taken on the line 16—16 in FIG. 15.

Figure 1:
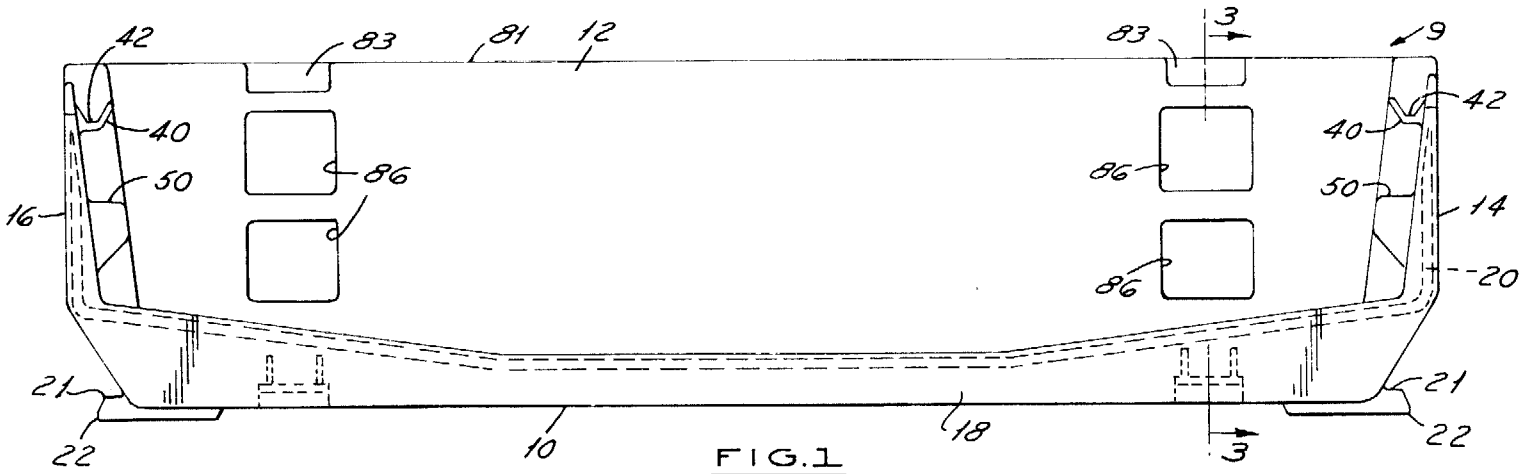
FIG. 1 is a front view of a container constructed in accordance with the invention.

Referring now particularly to the drawings and especially to FIGS. 1–18 thereof, the container of this invention is generally designated 9 and consists essentially of a bottom wall 10, a rear wall 12 extending upwardly from the rear edge of the bottom wall, side walls 14 and 16 extending upwardly from opposite side edges of the bottom wall, and a low front barrier or retainer wall 18 extending upwardly from the front edge of the bottom wall. The front of the container is substantially open as shown in FIG. 1, the barrier or retainer wall 18 at the front being of minimum height to strengthen the container and to provide a means for preventing goods in the bottom of the container from inadvertently spilling or falling out. The side and rear walls 12, 14 and 16 extend upwardly to substantially the full height of the container being slightly outwardly flared in an upward direction to facilitate stacking. It will be noted that a reinforcing rod 20 is molded into the container at the front, having its end portions disposed at the forward edges of the side walls and its intermediate portion extending across the top of the front barrier wall 20. This reinforcing rod resists spreading of the forward edge portions of the side walls under load.

The container is formed of any suitable material, preferably plastic, such for example as molded polyethylene or polypropylene. The bottom of the container is preferably of an open grid construction as shown so that it may be readily rinsed down and kept clean. While the container may be used for an indefinite number of purposes it is designed primarily for use as a bakery container to contain bread, rolls, cakes and the like.

Figure 2:
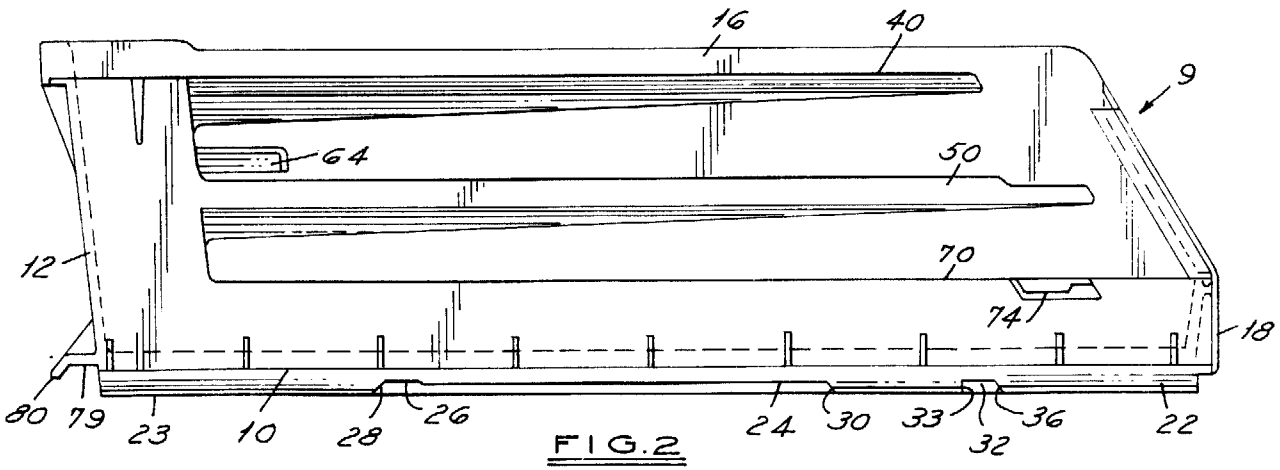
FIG. 2 is a side elevational view of the container shown in FIG. 1.
Figure 8:
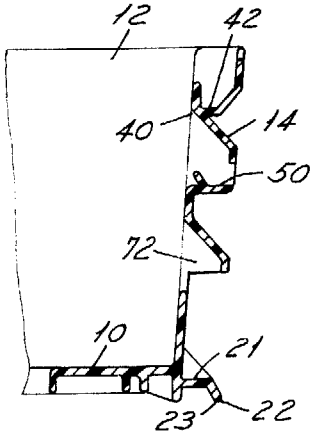
FIG. 8 is a sectional view taken on the line 8—8 in FIG. 3.

Extending from front to rear along each side of the container at the bottom is a laterally outwardly extending flange 21 which at its end inclines downwardly and outwardly to provide a supporting foot 22. The feet along the two sides of the container are of the same construction. The lower horizontal edges 23 of the feet are adapted to engage and slide upon the rails, hereinafter more fully described, of another container of identical construction to a stacked position thereon. These lower edges of the rails intermediate their length each have an elongated recess 24, the longitudinal outline of which is best seen in FIG. 2. The base of the recess throughout most of its length is horizontal but has a deeper portion 26 at the rear, with end portions 28 and 30 which slope downwardly and away from each other. Between the recess 24 and the forward end of each foot there is a second recess 32 having a vertical rear wall 33 and a front wall 36 sloping downwardly and to the front.

The side walls of the container are of identical construction and are molded so as to form stacking supports for a second container of identical construction. These stacking supports are provided at a plurality of different levels, in this instance three, so that two containers may be stacked at any one of the three levels. The uppermost stacking supports on the two side walls comprise the horizontal rails 40 which are on the inside of the side walls in laterally spaced relation to one another in the same horizontal plane. These rails are open at the front of the container and extend horizontally for substantially the full front to rear dimension of the container, terminating a short distance from the front and rear. The rails 40 are channels of generally U-shaped cross section throughout their length. The front and rear portions of the bottom 42 of each channel are horizontal, and the mid portion has a raised section 44 of the same shape as the recess 24 in each foot 22. The raised sections 44 are directly above recesses 24. Such raised sections are slightly smaller than the recesses for stacking purposes as will become apparent hereinafter. The raised section 44 has an enlarged head 45 corresponding in shape to the deeper portion 26 of recess 24. Thus the recess 24 in the feet are adapted to fully receive the raised section 44 at the bottom of rails 40 of a lower container when stacked thereon at the upper level.

Figure 3:
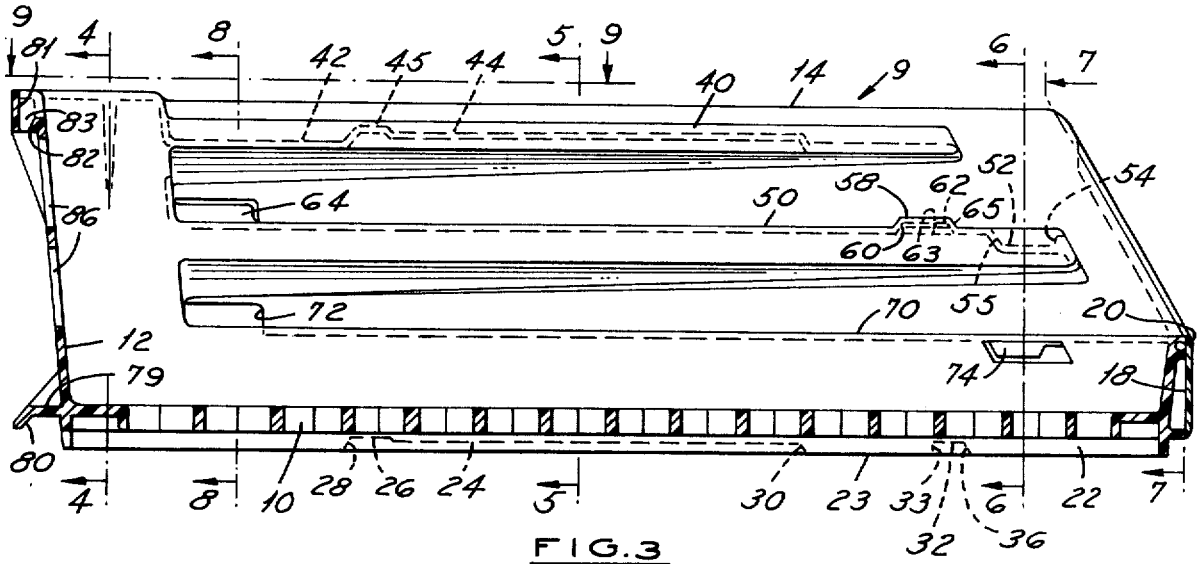
FIG. 3 is a sectional view taken on the line 3—3 in FIG. 1.
Figure 4:
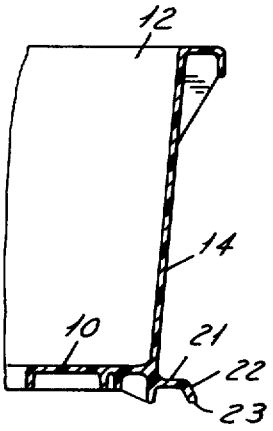
FIG. 4 is a sectional view taken on the line 4—4 in FIG. 3.
Figure 6:
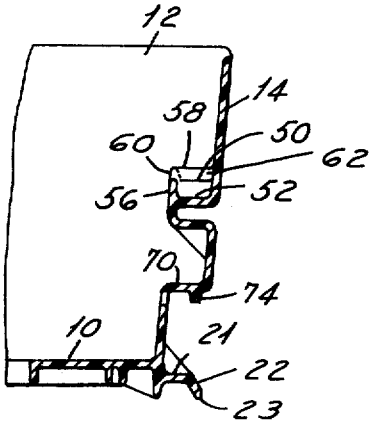
FIG. 6 is a sectional view taken on the line 6—6 in FIG. 3.
Figure 5:
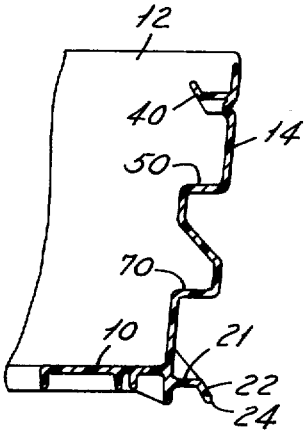
FIG. 5 is a sectional view taken on the line 5—5 in FIG. 3.
Figure 7:
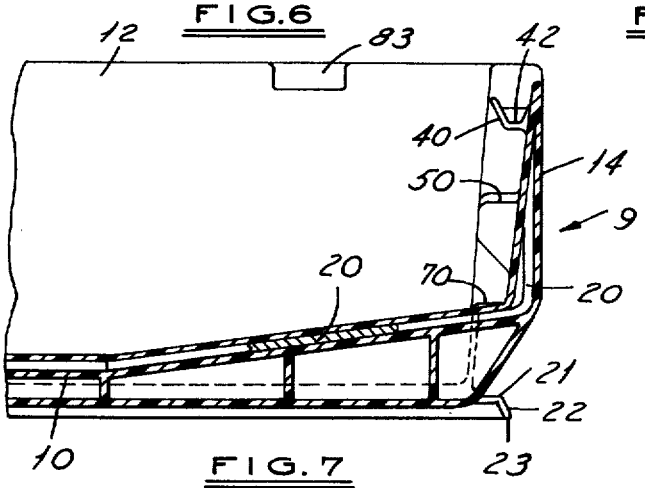
FIG. 7 is a sectional view taken on the line 7—7 in FIG. 3.
Figure 9:
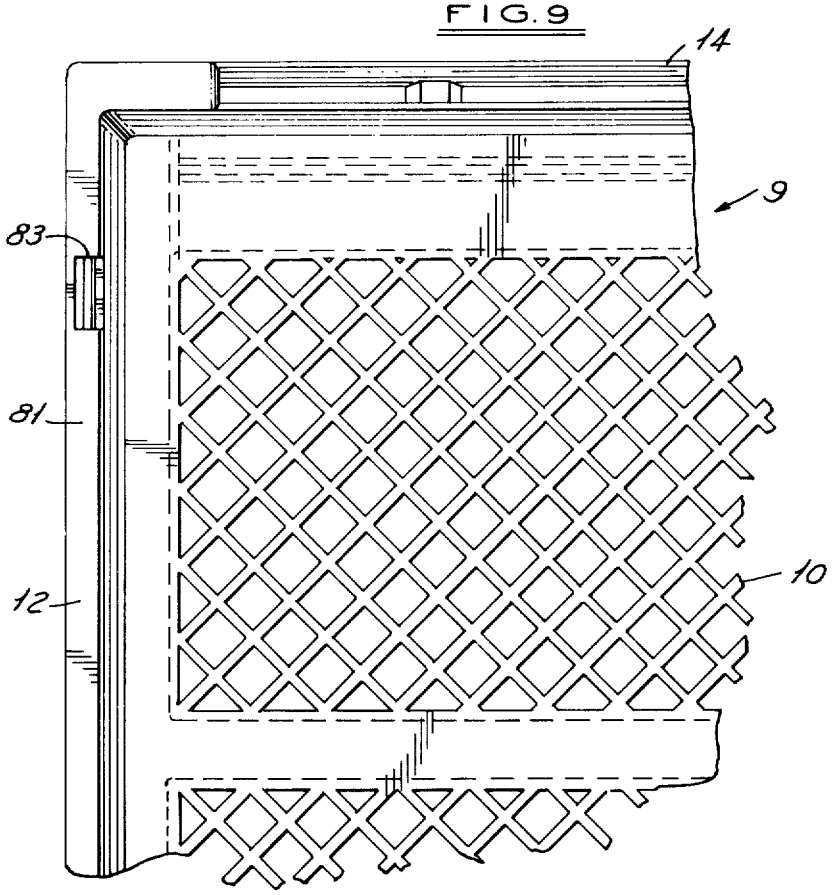
FIG. 9 is a fragmentary top plan view of a rear corner portion of the container taken on the line 9—9 in FIG. 3.
Figure 11:
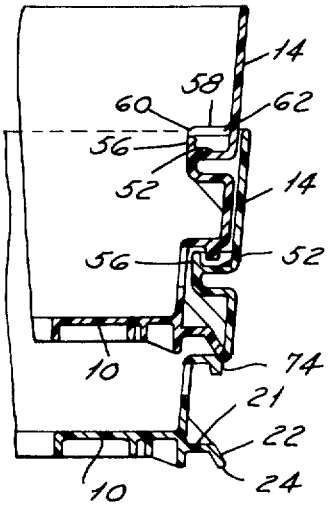
FIG. 11 is a sectional view taken on the line 11—11 in FIG. 10.
Figure 10:
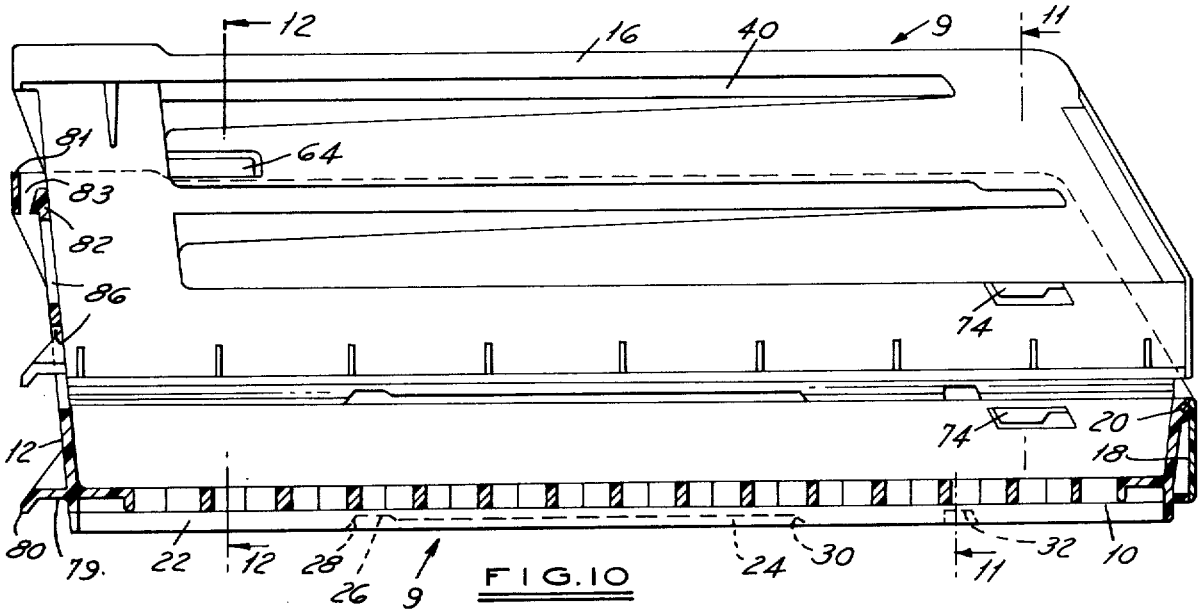
FIG. 10 is a side view of two identical containers stacked at the lowermost level, the lower container being shown in section and the upper container in elevation.

The stacking supports at the intermediate level comprise a pair of rails 50 on the inside of each of the side walls in laterally spaced relation in the same horizontal plane beneath rails 40. These rails 50 are open at the front of the container and extend horizontally for substantially the full front to rear dimension of the container, terminating short of the front and rear. The front ends of rails 50 extend forwardly beyond the front ends of rails 40. There is a pocket 52 formed in the front portion of each rail 50. This pocket is shown in FIGS. 3 and 6 and has front and rear walls 54 and 55 which incline upwardly away from each other and a vertical inner flange or wall 56. Rearwardly of the pocket 52 the rails 50 each have an upwardly projecting generally L-shaped rib 58. The ribs 58 each have a longitudinally extending leg 60 and a transverse leg 62. Each transverse leg 62 is directly above recess 32 and has a vertical rear wall 63 and an upwardly and rearwardly inclined front wall 65. The outline of leg 65 is the same generally as the recess 32 but slightly smaller so that it may fit in the recess of a container with which it is stacked. At the rear, each rail has along its inner edge a longitudinally extending upward projection or rib 64 which is inclined upwardly and inwardly at approximately the same angle as the feet of the container. The pocket 52 and the ribs 58 and 64 are provided for a purpose which will become more apparent hereinafter.

The stacking supports at the lowermost levels comprise the rails 70 one on the inside of each side wall, disposed in laterally spaced relation in the same horizontal plane beneath the rails 40 and 50. The rails 70 are at or slightly above the level of the front barrier wall 18. The rails 70 are open at the front and extend horizontally for substantially the full front to rear dimension of the container, terminating a short distance from the front and rear. The front ends of the rails 70 extend forwardly beyond the front ends of rails 50. There is a cutout 72 in the side of the container near the rail extending up from the level of the rail 70 at its rear end. A longitudinally extending rib 74 projects downwardly from each rail 70 at its front end. The contour of this rib 74 is substantially the same as although slightly smaller than the pocket 52, as seen in FIG. 3 for stacking purposes as will become more apparent as the description proceeds.

The rear wall has a pair of laterally spaced horizontal flanges 79 near the bottom extending outwardly and then terminating in an outwardly inclined downward lug 80. There is at the top of the rear wall a thickened transversely extending bead 81 formed with a pair of slots 83 which extend vertically and are open both at the top and the bottom. The front wall 82 of the slots is inclined at substantially the same angle as the lug 80 of the flange 79. The rear wall is apertured as shown forming two pairs of laterally spaced clearances 86. The lugs 80, slots 83 and clearances 86 of each pair are vertically aligned as shown in FIG. 1.

The containers are adapted to stack directly above one another when similarly oriented by horizontally sliding one over the other at the desired stacking level. The feet 22 are spaced apart the same distances as the rails at each stacking level. The containers are stacked by placing the feet of an upper container on the forward ends of the rails of a similarly oriented lower container at the desired level. Since the front ends of the rails at the middle level project forwardly farther than the front ends of the upper rails and since the front ends of the lowermost rails project still farther forwardly it is a simple matter to engage the feet with the rails at the desired level. The middle stacking level may be located quickly by placing the feet of the upper container upon the forward ends of the upper rails 50 and then withdrawing the upper container in a forward direction to allow the feet to drop down to the rails at the middle level.

When stacking at the upper level, the rear ends of the feet of an upper container are engaged with the front ends of the rails 40 of the lower container. The upper container is then slid rearwardly. The rear ends of the feet will cam over the raised section 44 of the bottoms of the rails 40 and just before reaching fully stacked position the rear ends of the feet will engage the head 45 of the raised section 44 (FIG. 17) to elevate the rear of the upper container sufficiently to lift the lugs 80 at the rear of the upper container above the slots 82 so that when moved further rearward to fully stacked position the lugs will drop into the slots at the same time the recesses 24 in the feet fully engage the raised sections 44. The engagement of the lugs 80 with the slots 83 and the engagement of the recesses 24 over the raised sections 44 of the rails resists horizontal sliding movement of the upper container in a forward direction away from the stacked position. This stacked position is shown in FIG. 15. It will be clear that no rearward movement of the upper container may take place because of the engagement of the lugs 80 with the backs of the slots 83. The bottom of the upper container of course fits down between the side walls of the lower container far enough to prevent lateral shifting. The channel-shape of the rails further resists lateral shifting and the inner flanges of the channels cooperate with the feet of the stacked container to resist spreading of the side walls of the lower container under load.

The upper container can be unstacked by a straight forward pull causing lugs 80 to cam out of slots 83 and recesses 24 to cam over raised sections 44.

Figure 13:
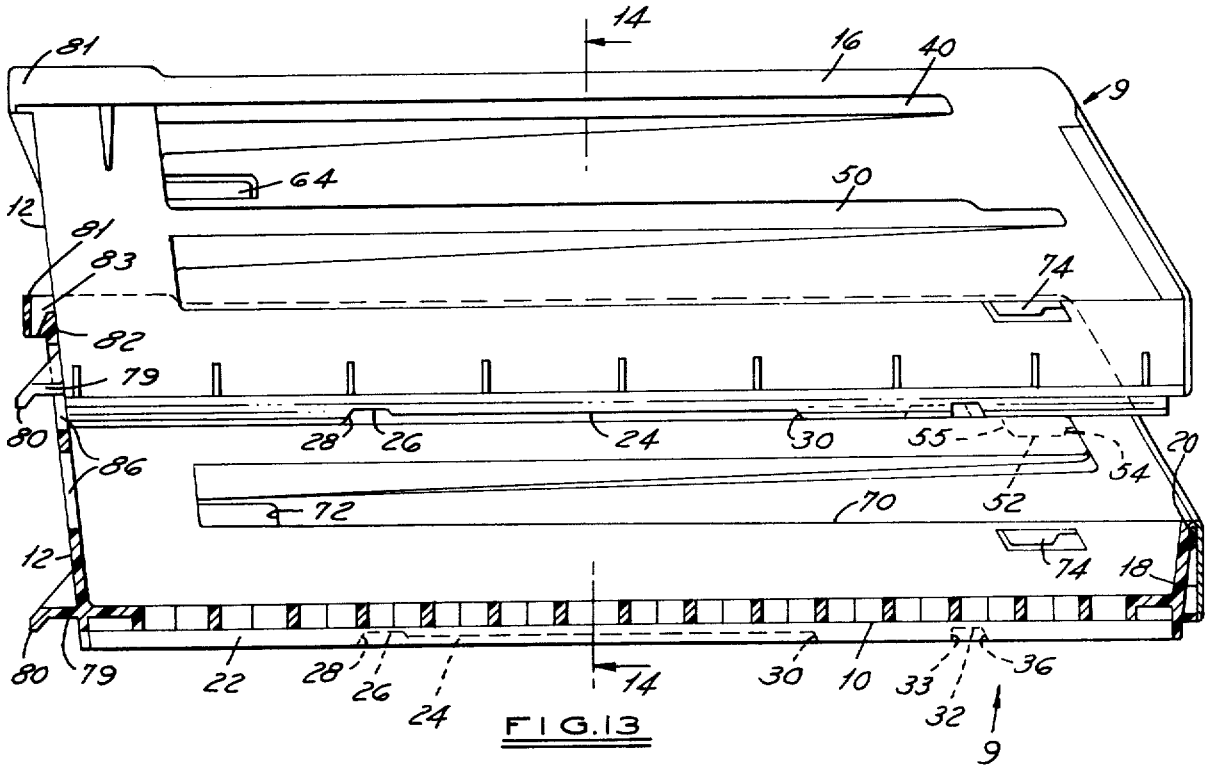
FIG. 13 is a side view similar to FIG. 10 showing the two containers stacked at the middle level.
Figures 17, 18:
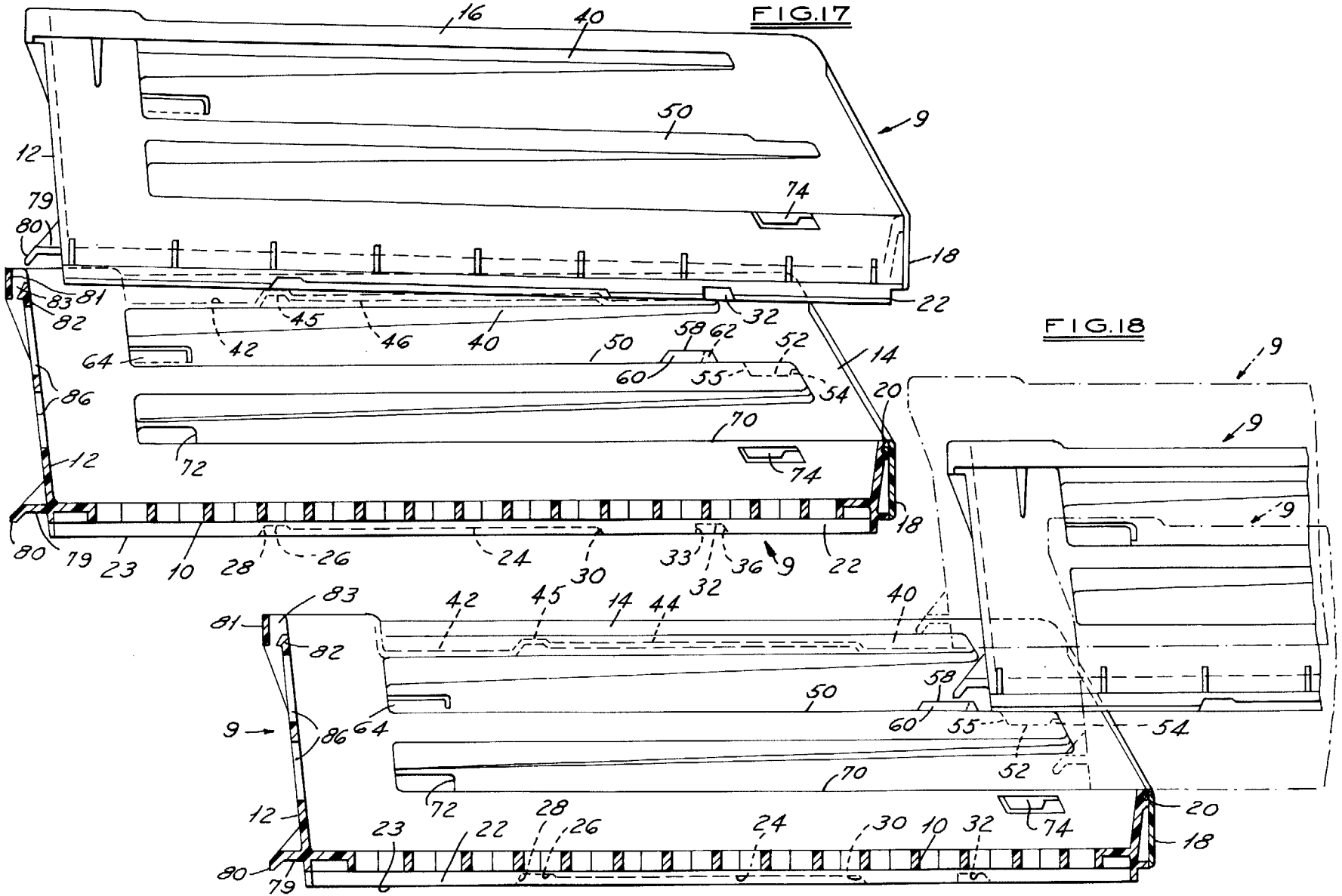
FIG. 17 is a view similar to FIG. 15 showing the upper container moving to a stacked position at the uppermost level just before it reaches the fully stacked position.
FIG. 18 is a side elevational view showing the relationship of an upper container to a lower container at the beginning of its sliding movement to a stacked position at each of the three levels.
Figure 19:
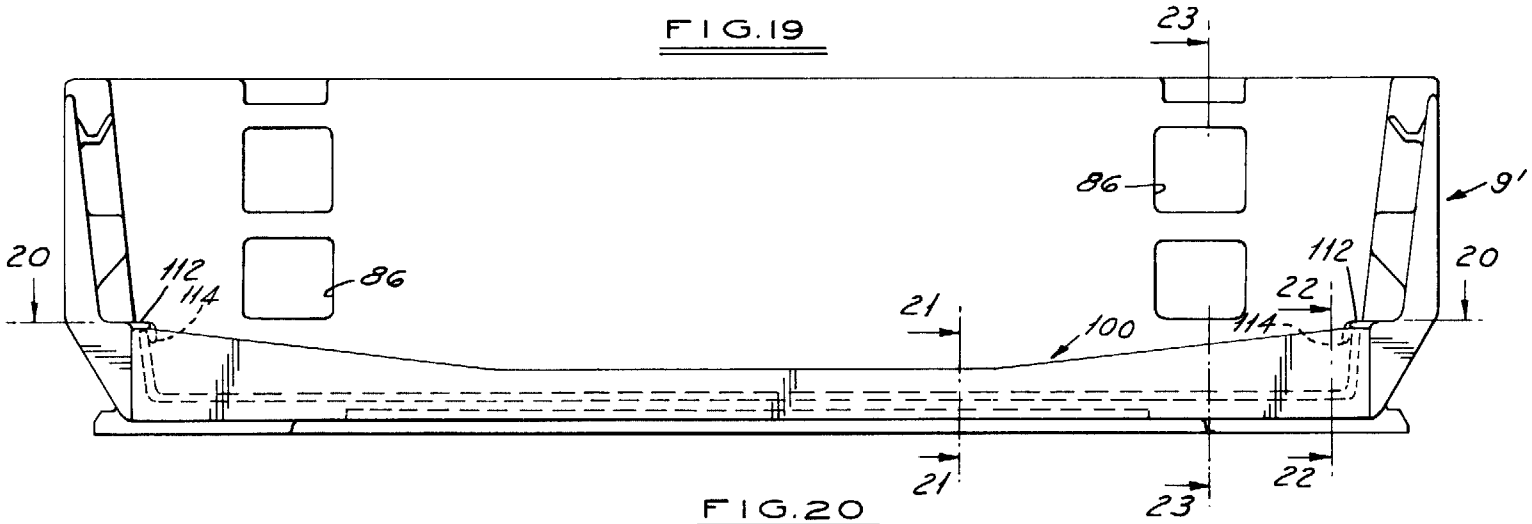
FIG. 19 is a front elevational view of a container having a modified construction, being provided with a tray or drawer in the bottom.

When stacked at the intermediate level as shown in FIG. 13, the lower edges of the feet engage the rails 50 and slide rearwardly until the full stacked position is reached in which the lugs 80 at the rear of the stacked container project through the upper clearances 86 in the rear wall of the lower container. In this fully stacked position, the recesses 32 in the lower edges of the feet engage over the transverse legs 62 of the L-shaped ribs 58. The vertical rear walls 63 of these legs 62 engage the vertical rear walls 33 of the recesses 32 to prevent forward sliding of the upper container away from stacked position. The rear and side walls of the lower container prevent rearward or sidewise movement of the upper container. The rear walls 65 of the legs 62 are inclined upwardly and rearwardly so that the fronts of the feet of the container being stacked cam over the legs 62 when being slid to the stacked position. Spreading of the side walls of the lower container is resisted by engagement of the feet of the upper container with the ribs 64 and the legs 60 of the L-shaped ribs 58 of the lower container. The cutouts 72 are provided to clear the ribs 64 during the sliding movement of the upper container to stacked position (see FIG. 12). The upper container can be unstacked by a straight forward pull, initially lifting the front to clear legs 62. The rear walls 63 of legs 62 and the rear walls 33 of recesses 32 may be inclined upwardly and forwardly rather than being vertical so that the recess 32 will cam over leg 62 to make it easier to unstack without initially lifting the front of the upper container.

Stacking at the lowermost level is accomplished by engaging the feet of the upper container with the rear ends of the rails 70 of the lower container and sliding rearwardly until lugs 80 project through the lower clearances 86 at the rear of the lower container and ribs 74 fall into the pockets 52. The rear walls 54 of the pockets 52 engage the rear walls of the ribs 74 to resist forward sliding of the upper container away from stacked position. The ribs 74 also cooperate with the inner walls 56 of the pockets to resist spreading although spreading is not a particular problem when stacking at the lowermost level. The rear and side walls of the lower container prevent rearward or sidewise movement of the upper container. The upper container can be unstacked by a straight forward pull causing the ribs 74 to cam out of pockets 52. The barrier wall 18 is slightly below the bottom of an upper container stacked at the lowermost level and hence does not interfere with the movement of the upper container to or from stacked position.

At each of the three levels of stacking, the upper container is oriented the same way as and is disposed directly above the lower supporting container. When an upper container is stacked at the uppermost level, relatively high bakery products such as bread loaves may be supported in the lower container. When the upper container is stacked at the lowermost level, relatively low bakery products such as rolls or coffee cakes may be placed in the bottom of the lowermost container. Bakery products of an intermediate height may be placed in the lower container when the upper container is stacked at the intermediate level.

Figure 29:
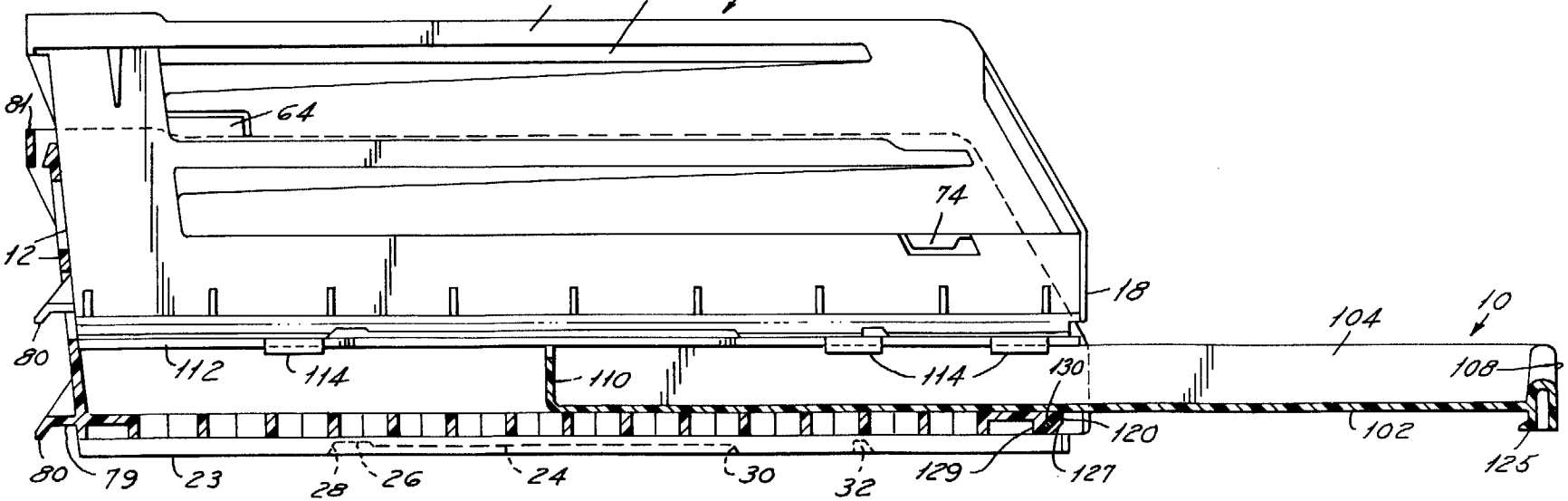
FIG. 29 is a side view showing two containers stacked at the lowermost level and with the drawer or tray in the bottom of the lower container partially extended.

The embodiment disclosed in FIGS. 19 to 29 differs from the one first described in that it has a pull-out drawer or tray 100 in the bottom. This container is designated 9' and is like the container 9 but differs in the particulars hereinafter noted. Container 9' does not have a barrier wall or retainer equivalent to the barrier wall 18 in FIGS. 1–18. The tray 100 has a triangular bottom wall 102, vertical side walls 104 and 106, and vertical front and rear walls 108 and 110. The front wall 108 of the tray near the sides is substantially the same height as the barrier wall 18 of the previously described embodiment, but is of reduced height near the center to allow limited access to the contents of the tray. The width of the tray between the side walls is approximately equal to the distance between the side walls 14 and 16 of the container near its bottom wall 10 so that the tray is capable of sliding on the bottom wall of the container from the stored position shown in FIG. 23, in which it is completely within the container with its rear wall abutting the rear wall of the container, to a fully or partly withdrawn position pulled out from the front of the container. FIG. 29 shows the tray pulled part way out of the container and it will be seen to be disposed beneath an upper container stacked at the lowermost level so that it may slide in and out without interference The side walls of the container 9' have inwardly extending ribs 112 which extend horizontally from front to rear of the container over the upper edges of the side walls of the tray to keep the tray from lifting up. Downturned retainers 114 provided at spaced points along these ribs extend along the inner surfaces of the side walls 104 and 106 of the tray to slidably engage and retain the side walls. The upper edge of the rear wall 110 of the tray is notched at the outer corners to clear the retainers 114 when the tray is withdrawn through the open front of the container.

Figure 20:
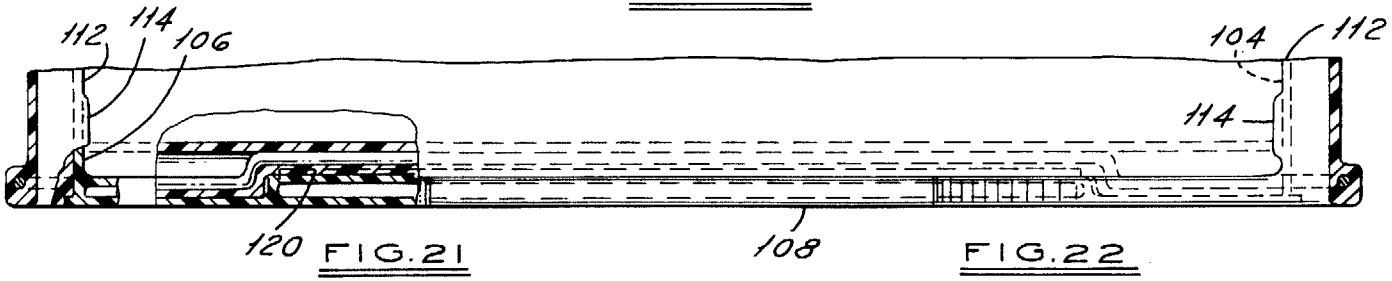
FIG. 20 is a sectional view taken on the line 20—20 in FIG. 19.
Figure 22:
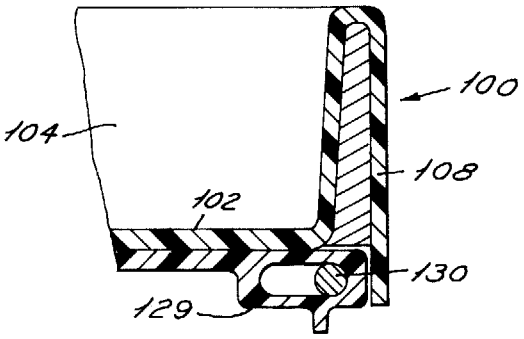
FIG. 22 is a sectional view taken on the line 22—22 in FIG. 19.
Figure 21:
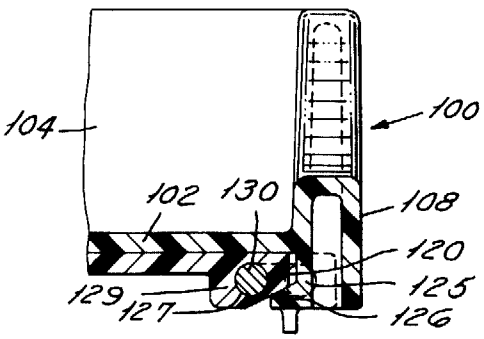
FIG. 21 is a sectional view taken on the line 21—21 in FIG. 19.
Figure 23:
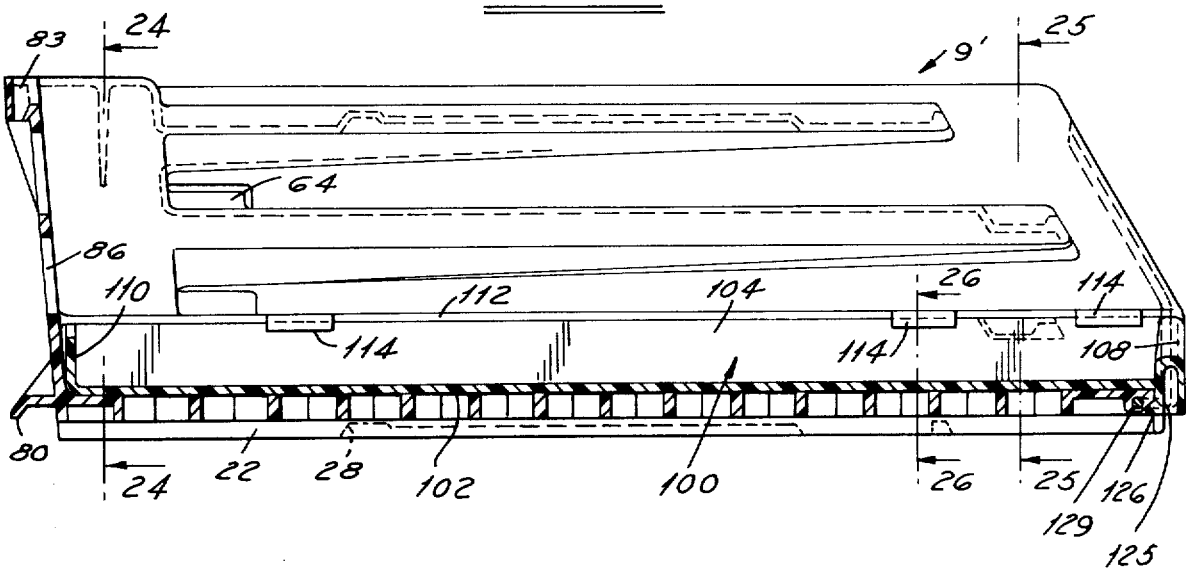
FIG. 23 is a sectional view taken on the line 23—23 in FIG. 19.
Figure 24:
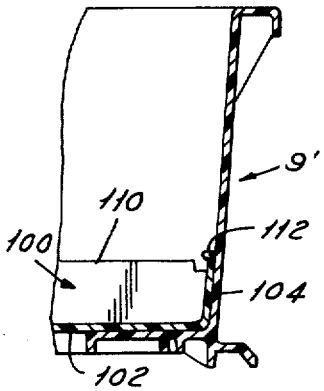
FIG. 24 is a sectional view taken on the line 24—24 in FIG. 23.
Figure 25:
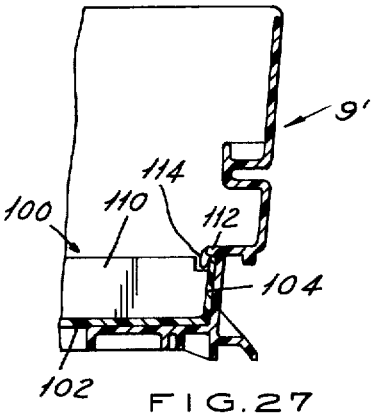
FIG. 25 is a sectional view taken on the line 25—25 in FIG. 23.
Figure 26:
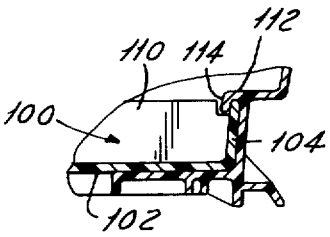
FIG. 26 is a sectional view taken on the line 26—26 in FIG. 23.
Figure 27:
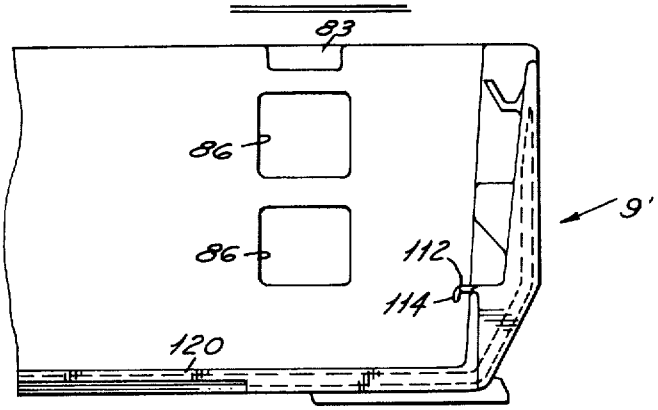
FIG. 27 is a fragmentary front elevational view of the container with the drawer or tray removed.
Figure 28:
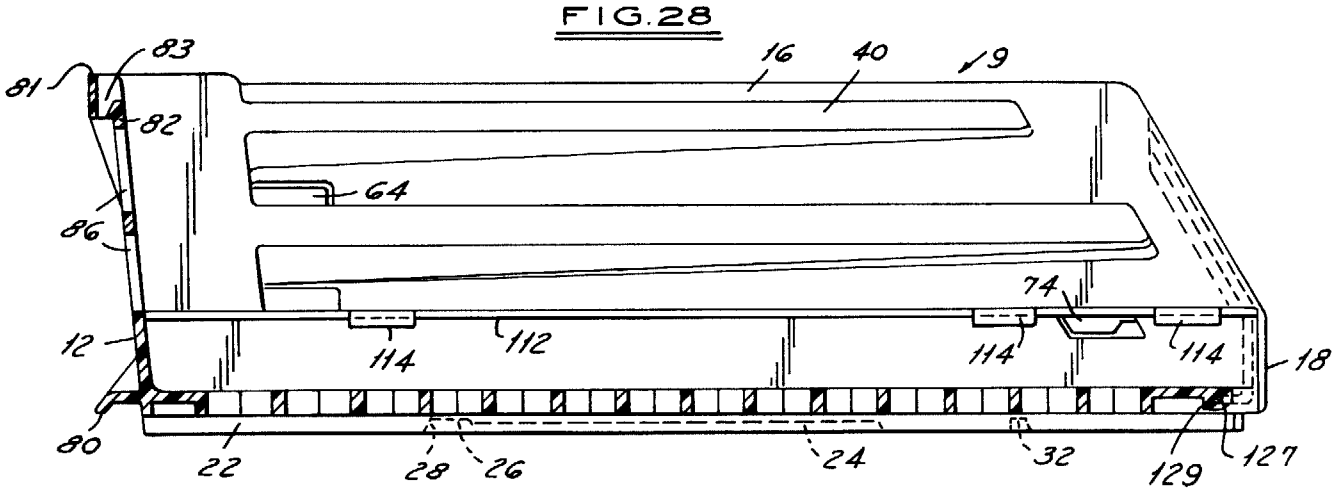
FIG. 28 is a view similar to FIG. 23 but with the tray or drawer removed.

As seen in FIGS. 20–22, the front edge of the bottom wall 10 of the container 9' is centrally recessed in a rearward direction as indicated at 120. In the space of this central recess the front of the drawer has a depending intermediate section 125 provided with a downwardly and rearwardly tapered projection or lip 126 which wedgingly fits under a similarly tapered surface or keeper 127 on the reinforced bead 129 along the undersurface of the bottom wall as shown in FIG. 21 when the drawer is closed. This interengagement of the lip 126 with the tapered surface 127 on the bottom of the container prevents the front end of the tray from lifting up and also holds the front edge of the bottom wall of the container 9' from sagging under the weight of its contents.

The reinforcing rod 130 in the bead 129 across the front of the bottom wall of the container is provided to add strength to the container and has end portions which extend up into the front edge portion of the side walls. The intermediate part of this rod has a U-shaped central section which increases the strength of the rod and also permits it to follow the contour of the central recess 120 along the front edge of the bottom wall 10 of the container.

Without the tray it is difficult to get at items stored in the bottom of a lower container when an upper container is stacked at the lowermost level. The tray makes it much more convenient to remove or replace items in the bottom of the lower container by simply withdrawing the tray as far as may be necessary or by removing the tray entirely if desired.

What I claim as my invention is:

1. A stacking container comprising a generally rectagular bottom wall, first and second side walls extending upwardly from opposite sides of said bottom wall, means providing stacking supports at a plurality of levels above said bottom wall comprising a generally horizontal rail on each side wall at each level, said rails extending substantially from front to rear of said side walls, and feet adjacent the bottom of said side walls spaced apart substantially the same distance as the rails at each level, the feet of said container being adapted to slidably engage the rails of a lower container of identical construction of each of said levels adjacent the front of said rails to enable said container to be slid rearwardly to a stacked position with respect thereto at each of said levels and to be slid forwardly for unstacking, the front of said container being open sufficiently to permit stacking and unstacking as aforesaid.

2. The container defined in claim 1, wherein said rails at a lower level extend forwardly farther than said rails at a higher level to facilitate stacking at said lower level.

3. The container defined in claim 1, wherein said rails at one level and said feet have complementary portions such that when the feet of a stacked upper container of identical construction engage said rails at said one level said complementary portions interengage and resist horizontal sliding of said upper container to an unstacked position.

4. The container defined in claim 3, wherein said portions of said rails at said one level are provided by raised sections and said portions of said feet are provided by recesses of the same contour as said raised portions.

5. The container defined in claim 1, wherein said rear wall has complementary portions such that when said container is stacked on a lower container of identical construction at one level said complementary portions of the two containers interengage to resist horizontal sliding of the upper container to an unstacked position.

6. The container defined in claim 5, wherein when said container is stacked on a lower container of identical construction at said one level said complementary portions of the two containers interengage by a downward movement of the upper one of the two containers, and means on said rails at said one level engageable with the feet of the upper container during sliding movement toward a stacked relationship to raise and then lower the upper container to cause said complementary portions to interengage.

7. The container defined in claim 6, wherein said complementary portions are lugs near the bottom and slots near the top of said rear wall.

8. The container defined in claim 1, wherein the rails at one level have upwardly facing surfaces to support the feet if a stacked upper container of identical construction, said rails at said one level having generally upright flanges at their laterally inner edges cooperable with the feet of the stacked upper container to resist spreading of said side walls.

9. The container defined in claim 8, wherein said flanges are located near the front and rear ends of said rails at said one level.

10. The container defined in claim 1, wherein the rails at one level have upwardly facing surfaces to support the feet of a stacked upper container of identical construction, said rails at said one level having an abutment and said feet having a recess complementing said abutment in contour such that said recesses of the stacked upper container engage said abutments to resist sliding movement of said upper container away from stacked position.

11. The container defined in claim 1, wherein said rails at a first level have portions complementary to rail portions at a second level so that when stacked on a lower container of identical construction at the particular level in which the rails of the two containers at said first and second levels are in register said complementary portions interengage to resist sliding movement of the upper container away from stacked position.

12. The container defined in claim 11, wherein said complementary portions comprise projections on the rails at said first level and recesses in the rails at said second level.

13. The container defined in claim 12, wherein said projections and recesses when interengaged also resist spreading of the lower container.

14. A stacking container comprising a generally rectangular bottom wall, first and second side walls extending upwardly from opposite sides of said bottom wall, means providing stacking supports at a plurality of levels above said bottom wall comprising a generally horizontal rail on each side wall at each level, said rails extending substantially from front to rear of said side walls, and feet adjacent the bottom of said side walls spaced apart substantially the same distance as the rails at each level, the feet of said container being adapted to slidably engage the rails of a lower container of identical construction at each of said levels to enable said container to be slid to and from a stacked position with respect thereto at each of said levels, the rails at one level being channels of generally V-shape in cross section such that the feet of a stacked upper container of identical construction engage in said channels and cooperate with the inner sides of said channels to resist spreading of said side walls.

15. A stacking container comprising a generally rectangular bottom wall, first and second side walls extending upwardly from opposite sides of said bottom wall, means providing stacking supports at a plurality of levels above said bottom wall comprising a generally horizontal rail on each side wall at each level, said rails extending substantially from front to rear of said side walls, feet adjacent the bottom of said side walls spaced apart substantially the same distance as the rails at each level, the feet of said container being adapted to slidably engage the rails of a lower container of identical construction at each of said levels to enable said container to be slid to and from a stacked position with respect thereto at each of said levels, and a tray supported in a stored position on the bottom wall of said container beneath the position occupied by an upper container of identical construction stacked at the lowermost level, said tray being slidable in forward and rearward directions to and from said stored position.

16. The container defined in claim 15, wherein guide means are provided to guide the sliding movement of said tray and to retain it against lifting up with respect to said container.

17. The container defined in claim 15, including locking means on said tray and container which interengage in the stored position of said tray.

18. The container defined in claim 17, wherein said locking means comprises a projection of the front edge of said tray and a keeper on the front edge of said bottom wall which when interengaged prevent vertical separation.

* * * * *